US006874425B1

(12) United States Patent
Doughty

(10) Patent No.: US 6,874,425 B1
(45) Date of Patent: Apr. 5, 2005

(54) PROJECTILE CARRYING SUB-MUNITIONS

(75) Inventor: James L. Doughty, Neosho, MO (US)

(73) Assignee: Day & Zimmermann, Inc., Parsons, KS (US)

( * ) Notice: Subject to any disclaimer, the term of this patent is extended or adjusted under 35 U.S.C. 154(b) by 0 days.

(21) Appl. No.: 09/861,407

(22) Filed: May 18, 2001

(51) Int. Cl.[7] ..... F42B 12/60
(52) U.S. Cl. ..... 102/489; 102/357; 102/393; 86/20.14
(58) Field of Search ..... 102/226, 229, 102/235, 244, 251, 254, 357, 393, 489, 703; 86/20.1, 20.11, 20.12, 20.13, 20.14, 20.15

(56) References Cited

U.S. PATENT DOCUMENTS

| | | | | | |
|---|---|---|---|---|---|
| 138,907 | A | | 5/1873 | Markley | |
| 174,325 | A | | 2/1876 | Tyler et al. | |
| 2,809,583 | A | | 10/1957 | Ortynsky et al. | 102/393 |
| 3,093,072 | A | * | 6/1963 | Pigman | 102/393 |
| 3,712,229 | A | | 1/1973 | Schock | |
| 3,981,244 | A | * | 9/1976 | Adimari et al. | 102/489 |
| 4,157,068 | A | | 6/1979 | Rognmo | |
| 4,389,940 | A | | 6/1983 | Trembly et al. | 102/489 |
| 4,455,940 | A | | 6/1984 | Furuike | 102/489 |
| 4,480,552 | A | | 11/1984 | Eckel et al. | 102/489 |
| 4,488,489 | A | | 12/1984 | Schöffl | |
| 4,653,401 | A | * | 3/1987 | Gatti | 102/226 |
| 4,669,386 | A | | 6/1987 | Precoul et al. | |
| 4,726,292 | A | * | 2/1988 | Gatti | 102/227 |
| 4,744,301 | A | * | 5/1988 | Cardoen | 102/393 |
| 4,777,882 | A | * | 10/1988 | Dieval | 102/489 |
| 4,793,260 | A | | 12/1988 | Kruse et al. | |
| 4,811,664 | A | * | 3/1989 | Levy et al. | 102/226 |
| 4,869,174 | A | * | 9/1989 | Hanser et al. | 102/489 |

(Continued)

FOREIGN PATENT DOCUMENTS

| | | | | |
|---|---|---|---|---|
| DE | 30 48 617 A1 | | 7/1982 | |
| DE | 3732744 | | 4/1989 | 102/489 |
| DE | 37 32 751 A1 | | 4/1989 | |
| DE | 37 39 370 A1 | | 6/1989 | |
| DE | 38 41 908 A1 | | 7/1990 | |
| EP | 0 424 198 A1 | | 9/1990 | |
| EP | 395520 | | 10/1990 | 102/489 |
| EP | 0 481 874 A1 | | 10/1991 | |
| FR | 2831955 A1 | * | 5/2003 | F42B/8/18 |

OTHER PUBLICATIONS

Thomas, Sr., Submunition Fuse With Pyrotechnic Ignition, United States Statutory Invention Registration, Reg. No. H699, Published Nov. 7, 1989.

*Primary Examiner*—Michael J. Carone
*Assistant Examiner*—James S. Bergin
(74) *Attorney, Agent, or Firm*—Caesar, Rivise, Bernstein, Cohen & Pokotilow, Ltd.

(57) ABSTRACT

A projectile carrying sub-munitions which may exhibit orientational sensitivity utilizes a resilient member to prevent individual grenades from rotating out of the desired orientation. As a skilled artisan would readily understand, the sub-munitions is one type of rotationally sensitive device. Other types of rotationally sensitive devices include but are not limited to grenades, grenade fuses and sub-munition fuses. In the described embodiments, artillery shells carrying grenades packed in circular arrays around a central longitudinal axis may exhibit orientational sensitivity with some types of slide fuses, such that an optimal orientation is that the slide fuse faces outwardly along a radial line from the longitudinal axis. A resilient member, such as a resilient sleeve around one or more sub-munitions, is provided to with adequate elasticity, surface area, and coefficient of friction in contact with the sub-munitions to prevent the sub-munitions from rotating about their individual axes during shipment, storage, firing, and flight of the artillery shell.

27 Claims, 4 Drawing Sheets

U.S. PATENT DOCUMENTS 4,920,887 A 5/1990 Frehaut et al.
5,048,419 A * 9/1991 Skowasch ..... 102/226
5,076,171 A * 12/1991 Altenau et al. ..... 102/489
5,094,170 A 3/1992 Raynaud et al.
5,107,767 A 4/1992 Schneider et al.
5,107,768 A 4/1992 Langenohl
5,473,988 A 12/1995 Dion
5,684,267 A 11/1997 Dean ..... 102/489
5,864,086 A * 1/1999 Ettmuller ..... 102/489
6,640,723 B2 * 11/2003 Spivak et al. ..... 102/483
6,672,220 B2 * 1/2004 Brooks et al. ..... 102/489

* cited by examiner

PROJECTILE CARRYING SUB-MUNITIONS

FIELD OF THE INVENTION

The present invention relates to the field of munitions, and more particularly to the field of spin-stabilized projectiles which carry sub-munitions.

BACKGROUND OF THE INVENTION

Many types of artillery shells carry sub-munitions; and such sub-munitions are often arranged in stacks within the hollow main body of the shell. The U.S. 155 mm M864/M483 artillery round, for example, carries M42/M46 shaped-charged grenades in an array of stacked columns arranged in a circular pack around the inner periphery of the main body. The circular pack has seven grenades around the inner periphery and one grenade on the center line. German Patent Publication DE 3841-908-A is another representative of this type of artillery shell and shows the basic packing arrangement for the shaped-charge grenades. The grenade's cylindrical casing is designed for stacking by having a reduced diameter at the fuze end, which fits into the cone of the shaped-charge at the opposite open end and results in the open end of the casing being supported by the shoulder formed at the reduced diameter of the next grenade in the stack. The stacks are arranged radially around the longitudinal axis of the main body of the shell to form a circular pack, in this instance with six columns of grenades around the perimeter and one column on the center line. If the main body of the shell is viewed in a transverse section, the section will have six grenades evenly spaced around the perimeter and one grenade in the center.

The pack is held together by spacer bars between the perimeter stack grenades. The spacer bars are usually made in segments for each circular layer, with pins or similar connectors between the segments. The M864/M483 round adds to this configuration a plastic (polyethylene) sleeve around the center grenade to take up the gap caused by the size of the inner diameter of the 155 mm casing in relation to the diameter of the M42/M46 grenades.

Typically at least one of the spacer bars in a transverse section will have some mechanism for locking itself to the shell casing to prevent the grenade pack as a whole from rotating within the shell in reaction to the spin imparted by the rifling. In the above publication, for example, the spacer bar segments at one of the perimeter sides have a ridge to engage in a slot in the shell casing to prevent rotation of the pack as a whole.

Several other patent publications depict variations of grenades stacked in a radial array of columns inside an artillery shell. European Patent Publication 481-874-A discloses a grenade pack without a column of grenades in the center. Instead, a central spacer bar extends the length of the projectile and is attached to a piston in front of the grenade pack. The piston and bar bear the force of the ejection charge to detach the base and push out the grenade pack.

Spacer bars are often made of steel or heavy metal to achieve a mass distribution sufficient to impart stabilizing spin to the ejected grenades. The process of assembling the grenade pack with solid spacer bar segments requires the grenades to be assembled one layer at a time, with a press used to seat the spacer segments. In response to this loading difficulty, U.S. Pat. No. 5,473,988 discloses spacer bars made of nylon half-bar segments, each with a shallow groove pattern in the surface that cups the grenade, and slanted guiding surfaces that expand the width of the spacer when the half-bars are pressed together. The grooves compress against the grenade when the pack is pressed.

While the above configurations are intended to provide a tight pack and to prevent counter-rotation of the pack as a whole inside the shell, little or no importance has been given to the rotational orientation of the individual grenades within the stack or to the related problem of maintaining a particular orientation. Thus, while the spacer bar configuration prevent pack rotation, they do not prevent rotational movement of individual grenades within the pack.

There are pack configuration for special grenades that would prevent individual grenade rotation. German Patent Publication DE 3732-752-A shows a seven pack radial array with an eighth grenade in the center, with spacer bars between the radial grenades and a cylindrical sleeve around the center grenade. The grenades in this shell are a special configuration of grenade with three rods attached to the casing for the purpose of providing a stand-off of the shaped charge from an armored surface at detonation. Consequently, the spacer bars and sleeve must have grooves into which the rods can be fit. This special configuration of grenade and pack will prevent individual grenade rotation, but the same spacer bars and sleeve would not prevent rotation of grenades that do not have these stand-off rods.

As a result of proving grounds testing for safety certification of a grenade with a new fuze, the present invention determined that malfunction of slide-type fuzes such as the new fuze being tested can be related to the rotational orientation of the grenade in the pack; specifically, that the optimum orientation is to align the fuze slide deployment axis outward along the radial axis of the shell for those grenades in the perimeter columns of the pack. Merely making such alignment at the time of packing would be insufficient, however, if the grenades were not prevented from rotating within the pack to a different fuze orientation before in-flight ejection.

Efforts were made to prevent grenade rotation by using shims to compensate for variations in height of the grenade columns so that each column was subject to equal press force and compression, but hot and cold tactical vibration testing revealed that these initial compression forces were not retained. It was also realized that modifying the grenade casings to mechanically interlock with the spacer bars would not be cost effective and could compromise the performance of the grenades. An effective, low-cost solution to the problem was found in the replacement of the hard polyethylene sleeve around the center grenade by a larger diameter sleeve of more resilient material. Silicon rubber and soft polyurethane sleeves were tested and both found to prevent rotational migration.

The silicon rubber sleeve was selected for the safety certification of the new grenade fuze. Test 155 mm M864/M483 rounds were assembled with live M42/46 grenades equipped with the new fuze, and the grenades were packed with the fuze slide deployment axis of the perimeter grenades aligned radially outward. (The slide deployment axis of the center grenades will always be radially outward because those grenades are on the longitudinal axis or center line of the shell.) Over-sized resilient silicon rubber sleeves, formed by joining half-sleeves, were placed around the grenades in the center column to take up the gap between the center grenades and the perimeter grenades. The test rounds were subjected to a variety of environmental tests and eventual firing. No discernable rotational migration of the grenades was observed after the environmental tests. The munition was safety certified.

SUMMARY OF THE INVENTION

The invention is directed to a rotating projectile which carries sub-munitions that have a performance sensitivity to the rotational orientation of the sub-munition in relation to the projectile. In one embodiment, the projectile is an artillery shell carrying slide-fuzed grenades stacked in a radial array, and the performance sensitivity is enhanced by packing the grenades with the fuze slide deployment axis aligned outward along a radial axis of the shell. A resilient space filler is disposed in the center of the array to take up the gap between grenades and prevent rotational migration among the grenades. Where the circular array includes a center grenade, the space filler may be a sleeve around the center grenade. The invention further includes the method of assembling such a projectile.

BRIEF DESCRIPTION OF THE DRAWINGS

For the purpose of illustrating the invention, there is shown in the drawings a form which is presently preferred; it being understood, that the invention is not limited to the precise arrangements and instrumentalities shown.

DETAILED DESCRIPTION OF THE DRAWINGS

Figure 1:
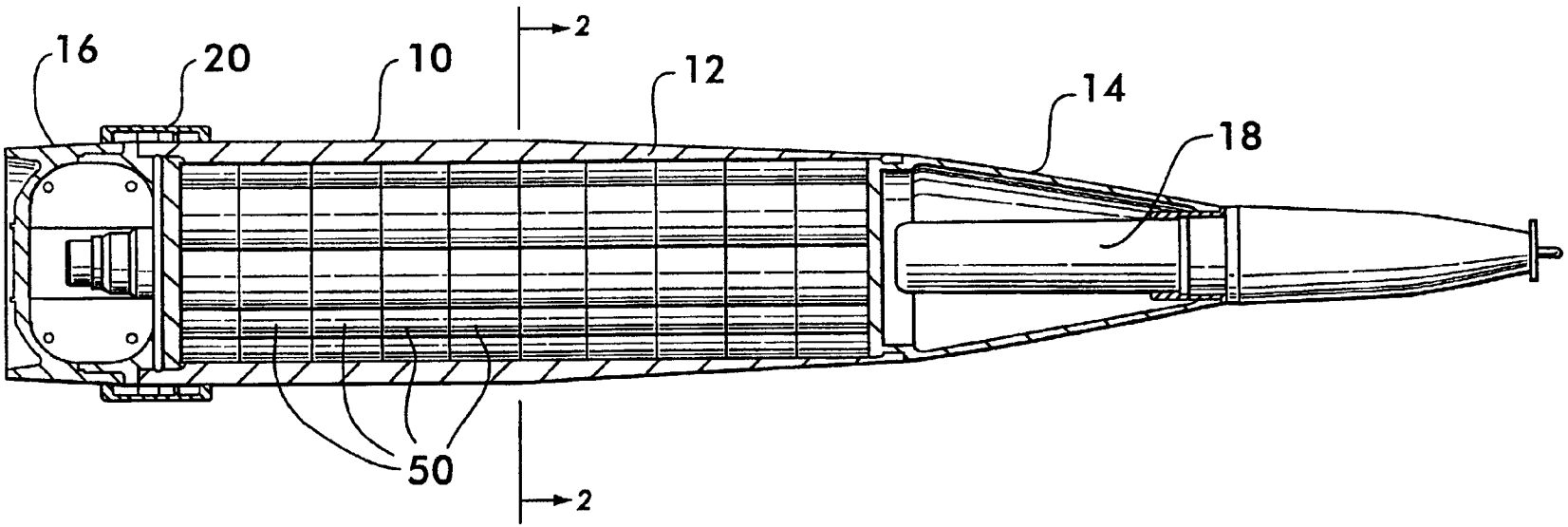
FIG. 1 is a longitudinal cross section of an artillery shell according to the prevent invention.

With reference to the drawings, starting at FIG. 1, there is shown an artillery shell which is generally identified by the numeral 10. The artillery shell 10 has a hollow main body 12, an ogive tip 14 at its forward end, and a base 16 at its rearward end. In the depicted embodiment the artillery shell 10 is a 155 millimeter M864 artillery shell. However, the scope of the invention is not limited by caliber. Artillery shells in 105 mm, 120 mm, 5-inch, and 8-inch calibers, as well as other projectiles which carry sub-munitions, can use the invention.

The main body 12 of the shell houses a pack of sub-munitions, in this embodiment shaped-charge grenades 50, described in greater detail below. A fuzed ejecting charge 18 is mounted in the ogive to detonate at a time or height determined by the fuze setting to blast the grenades 50 out of the base of the shell. A brass belt 20 near the base engages the rifling in the barrel of the artillery piece to impart stabilizing spin to the projectile in flight.

The sub-munitions carried within the artillery shell 10 may be any ordinance of acceptable size. The sub-munitions need not have special pins or interlocking elements to prevent migration when packed in carrier projectiles. The invention, however, is intended for use with sub-munitions that exhibit performance sensitivity to their rotational orientation at the time of ejection from the projectile. One group of sub-munition that has been found to exhibit such rotational sensitivity is grenades which have slide fuzes.

Figure 3:
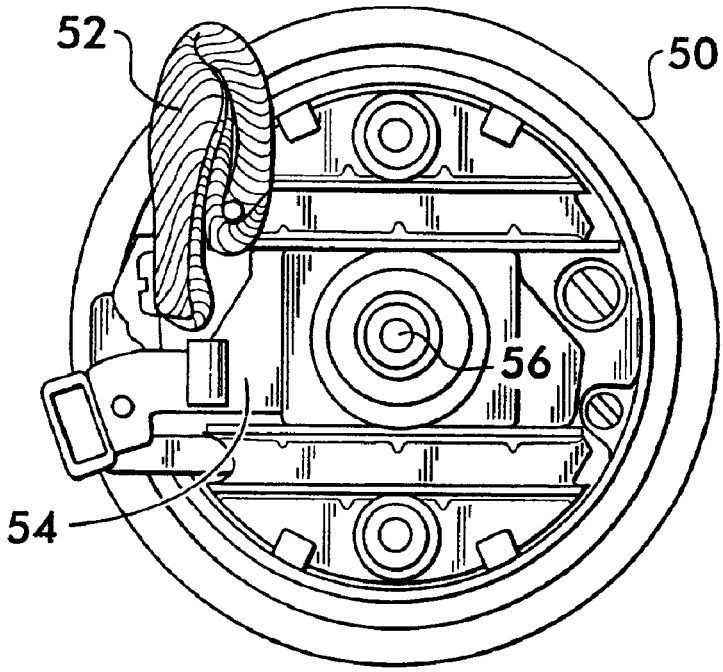
FIG. 3 is a top view of a fuze slide grenade in a safe configuration.
Figure 4:
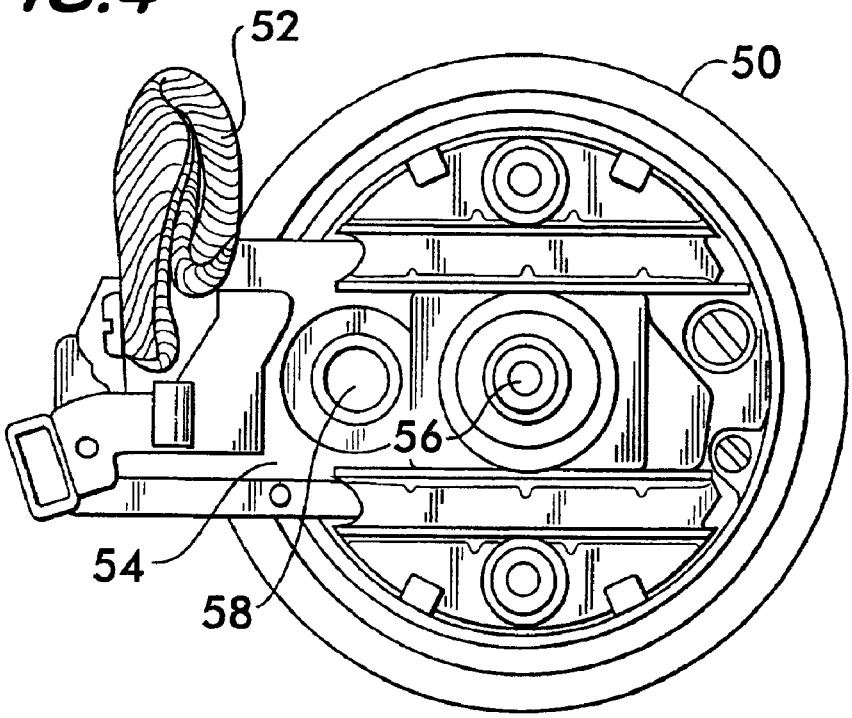
FIG. 4 is a top view of the grenade shown in FIG. 3 with the fuze slide in an armed configuration.

The grenades 50 may be M42/M46 shaped-charge armor piecing grenades. M42/46 grenades, as shown in FIGS. 3 and 4, include a fuze slide mechanism. In accordance with the present invention, the perimeter grenades 50*a* are preferably oriented with the fuze slide deployment axis aligned outward along a radial line from the longitudinal axis of the shell. Field tests have shown that the fuzes perform optimally when the slide is so aligned.

Figure 2:
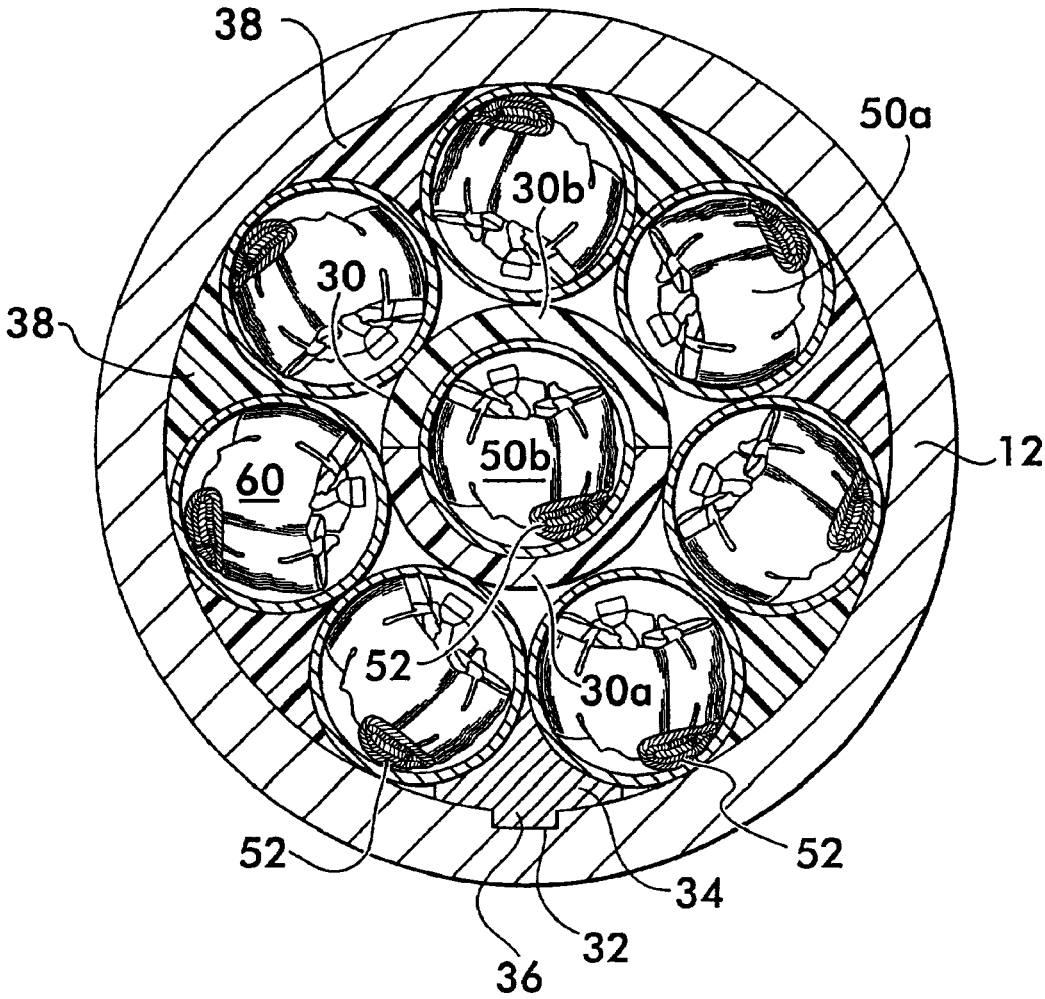
FIG. 2 is a transverse cross section of an artillery shell as shown in FIG. 1.

As can be seen in FIGS. 2 through 4, the fuze slide mechanism has a self destruct arming flag 52, described in greater detail below, disposed on the slide, 54. Thus, the slide deployment axis is properly aligned outward along a radial line of the shell when the self destruct arming flag 52 appears to be oriented outwardly from the center of the artillery shell 10.

As shown in FIG. 3, the fuze slide 54 is conventionally held in a safe or unarmed position by an arming screw 56 engaged through an aperture 58 (seen in FIG. 4) provided on the slide 54 and secured to a threaded member in the grenade body. The slide 54 is spring loaded such that, upon retraction of the arming screw 56, the slide 54 moves outwardly, as seen in FIG. 4.

When the artillery shell 10 detonates over the target, the grenades 50 are ejected out of the base of the artillery shell. Each grenade begins a spinning descent due to the rotational inertia imparted by the rotation of the artillery shell 10. A drag cord 60 (shown in FIG. 2) acts as a drogue in the airstream resisting the rotation of the grenade 50 and causing the arming screw 56 to retract from the slide. Once the arming screw 56 is retracted, the spring forces the slide 54 outwardly. In the safe position, the slide blocked a detonating pin in the fuze mechanism from contacting a detonator charge. When the slide 54 moves out to the armed position, the detonating pin is able to strike the detonator when grenade 50 impacts a target.

FIG. 2 shows a transverse cross section through the main body of the artillery shell. Inside the main body, seven columns or "stacks" of grenades 50*a* are radially arranged about the inner periphery of the main body. In accordance with the invention, the perimeter grenades 50*a* are optimally arranged such that the fuze slide of each grenade faces radially outward from the center or longitudinal axis of the main body. Thus, as can be seen in FIG. 2, the grenades are packed into the shell such that the self destruct arming flags 52 of each grenade are arranged facing radially outward.

In the preferred form of the invention shown in FIG. 2, another stack of grenades 50*b* is disposed in the center, along the longitudinal axis of the artillery shell 10. The fuze slide of each center grenade 50*a* will automatically face radially outward from the longitudinal axis of the main body because the grenade is on the longitudinal axis.

Still referring to FIG. 2, a series of spacer bar elements is used to define the position of the perimeter grenade stacks. A spacer bar element 34, 38 has a generally triangular shape. The longest side of a spacer 34, 38 is convex to correspond with the interior curvature of main body 12. The shorter sides of the spacer 34, 38 are concave to fit the shape of a grenade. The main body 12 of the shell has a channel 32 disposed on its interior running the length of the grenade pack. The spacer 34 has a ridge 36 provided along its convex side corresponding with channel 32.

In the form presently preferred, sleeves 30 formed from a resilient material are disposed around the central stack of grenades 50*b*. A sleeve 30 is preferably formed from two half-rings 30*a* and 30*b*, shaped in the form of half cylinders cut along a longitudinally bisecting line. The half-rings 30*a* and 30*b* contact one another to form the sleeve 30. The sleeve 30 has a height preferably equal to the height of one grenade 50. Thus, a sleeve is preferably placed around each grenade in the center stack. Each sleeve 30 has an outer diameter large enough to contact and deform around each of the perimeter grenades 50*a*. The outer surface of sleeve 30 thus makes substantial surface area contact with the perimeter grenades and has a coefficient of friction sufficient to hold the grenades 50*a* in the rotational orientation in which they are initially packed into the shell.

In a presently preferred embodiment, the sleeve 30 is formed from a silicone rubber. However, the sleeve 30 may be formed form many elastomers, such as polyurethane rubber, as well as other materials which exhibit the required elastic and frictional properties. The preferred silicone rubber, methylvinylpolysiloxane, has a hardness of 53 (+/−5) shore; tensile strength of 800 pounds per square inch; minimum elongation of 275%; maximum compression of 30%; tear strength of 88 pounds per inch; and specific gravity of 1.345 (+/−0.03). It has been found that curing this material at 450 degrees F for four hours provides a sleeve material with the desired qualities for the grenade arrangement shown in this embodiment.

As noted above, the sleeve 30 is preferably formed from two half-rings 30*a* and 30*b*. When the sleeve is employed in a 155 mm M864 artillery shell carrying M42/M46 grenades, the two half sleeves should have an inside radius of 0.75 inches with a tolerance of 0.01 inches (10 mils). The thickness of the half sleeves should be 0.260 inches, with a tolerance of 0.005 inches. The height of the half sleeves should be 1.795 inches, with a tolerance of 0.026 inches. The dimensions of the sleeve may change substantially when used with shells and grenades of different sizes.

Figure 5:
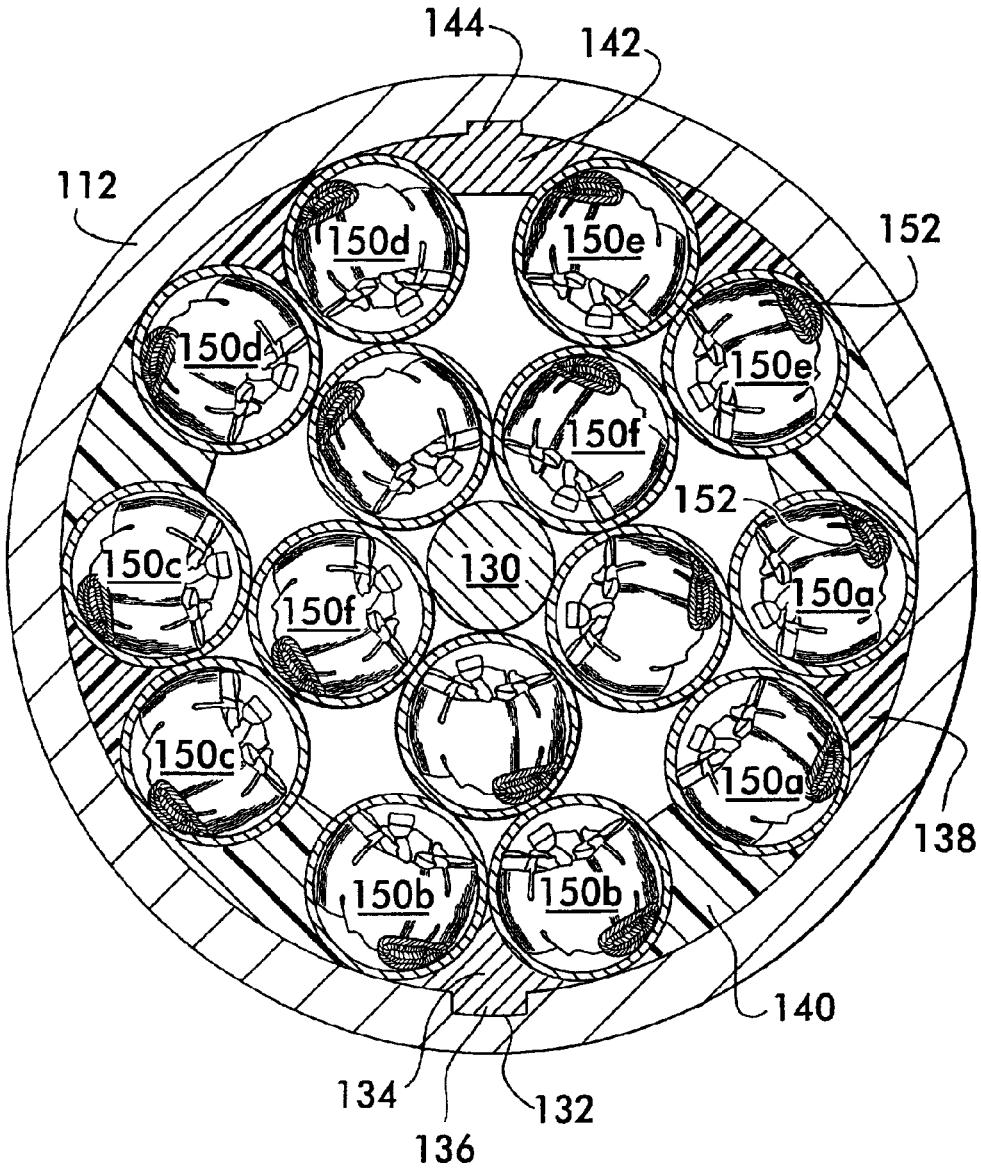
FIG. 5 is a transverse cross section of an alternative form of an artillery shell according to the prevent invention.

FIG. 5 shows a transverse section of an alternative form of the grenade pack, which has no central stack of grenades 50*b*. Instead, a centrally disposed solid resilient spacer 130 is provided to occupy the space between the grenades 150. The spacer 130 may be made from the preferred silicone rubber material described above. Alternatively, the resilient spacer may be formed from any material exhibiting the required resilient properties. This form of the invention is ideal for use in an eight inch shell, such as an M509 round. When used in an M509 or equivalent round employing M42/M46 grenades, the spacer should have a height of 1.795 inches (+/−0.01). The diameter of the preferred spacer, shaped as a cylinder, is 1.058 inches (+/−0.01).

When used with a larger shell, such as the eight inch round, the grenades 150 can be packed in two rings spaced about the centrally disposed resilient spacer 130, as shown in FIG. 5. A plurality of perimeter stacks 150*a* through 150*e* are arranged in pairs and disposed around the inner periphery of the main body 112. A series of spacer elements is used to define the position of the perimeter grenade stacks. A spacer bar element 134, 138, 140, 142 has a generally triangular shape. The longest side of a spacer 134, 138, 140, 142 is convex to correspond with the interior curvature of main body 112. The shorter sides of the spacer 134, 138, 140, 142 are concave to fit the shape of a grenade. A first pair of grenades 150*a* are separated by a small spacer 138. The main body 112 of the shell has a channel 132 disposed on its interior running the length of the grenade pack. The spacer 134, which serves to separate a second pair of grenades 150*b*, has a ridge 136 provided along its convex side corresponding with channel 132. Separating the first pair of grenades 150*a* and the second pair of grenades 150*b*, is a large spacer 140. The remaining pairs of peripheral grenades 150*c*, 150*d* and 150*e* are similarly spaced. The configuration of the peripheral grenades shown in FIG. 5 provides a spacer 142 with a ridge 144 counterbalancing the weight of the ridge 136.

A second plurality of grenade stacks 150*f* is disposed between the resilient spacer 130 and the perimeter grenades 150*a* through 150*e*. The configuration of grenades 150*a* through 150*e* in pairs provides snug contact between each pair of perimeter grenades 150*a* through 150*e* and one of the grenades 150*f*. The snug contact provided by spacer 130 with grenades 150*f*, in conjunction with contact between each of the grenades 150*f* and one pair of peripheral grenades 150*a* through 150*e*, each being in contact with spacers 134, 138, 140, 142, prevents rotational migration of each grenade 150.

Similar to the grenades 50*a* shown in FIG. 2, grenades 150*a* through 150*f* each have a fuze slide mechanism optimally aligned outwardly along a radial line of the shell, each fuze slide mechanism having an arming flag 152 disposed on the end thereof.

Whether solid or hollow, the central spacer may be a cylinder, which for reasons of economy is presently preferred, or may be formed in any appropriate shape. In a projectile carrying seven stacks of sub-munitions around the spacer, for example, a resilient spacer with a roughly heptagonal cross section may be appropriate. Yet another appropriate shape for the resilient spacer is a cylinder with a number of concave sections corresponding to the surface of a round grenade casing.

The present invention may be embodied in other specific forms without departing from the spirit of essential attributes thereof and, accordingly, reference should be made to the appended claims, rather than to the foregoing specification, as indicating the scope of the invention.

What is claimed is:

1. A method of packing rotationally sensitive devices into a projectile adapted to spin upon being fired by an applied external force, the projectile having a hollow main body with a longitudinal axis; the method comprising the steps of:

arranging the rotationally sensitive devices in the main body of the projectile such that each rotationally sensitive device is oriented in a pre-ejection position as desired along a radial line from the longitudinal axis of the main body; and inserting packing structure into the main body that deforms around each rotationally sensitive device and frictionally holds each rotationally sensitive device to prevent the rotationally sensitive devices from sliding and rotating out of such orientation prior to ejection from the projectile and allows ejection of the rotationally sensitive devices from the projectile.

2. The method of claim 1 wherein the step of arranging the rotationally sensitive devices includes arranging the plurality of the rotationally sensitive devices in stacks around a periphery of the main body.

3. The method of claim 2 wherein the step of arranging the sub-munitions further includes arranging a second plurality of the sub-munitions in stacks between at least one centrally disposed resilient ember and the first plurality of the sub-munitions arranged in stacks around the periphery of the main body.

4. The method of claim 3 wherein the centrally disposed resilient member is solid.

5. The method of claim 2 wherein the step of inserting packing structure includes packing at least one resilient member contacting all of the rotationally sensitive devices in at least one transverse section of the main body.

6. The method of claim 5 wherein the packing structure is at least one solid resilient member having a center disposed along the longitudinal axis of the main body.

7. The method of claim 2 wherein the step of arranging the rotationally sensitive devices further includes arranging a center stack of rotationally sensitive devices along the longitudinal axis of the main body.

8. The method of claim 7 wherein the step of inserting packing structure includes packing at least one resilient member contacting all of the rotationally sensitive devices in at least one transverse section of the main body.

9. The method of claim 8 wherein the step of inserting packing structure includes disposing at least one resilient sleeve around at least one rotationally sensitive device in the center stack, and deforming the packing structure around the at least one rotationally sensitive device in the center stack.

10. The method of claim 1, wherein the step of arranging the rotationally sensitive devices includes arranging the rotationally sensitive devices such that a fuze slide of each device is oriented substantially radially outward from the longitudinal axis of the main body.

11. The method of claim 1, wherein the projectile includes substantially cylindrical stacks in the main body, each stack arranged for housing one of the rotationally sensitive devices, the step of arranging the rotationally sensitive devices further including arranging each rotationally sensitive device in a respective stack.

12. The method of claim 1, further comprising curing the packing structure to at least a predetermined tear strength.

13. The method of claim 1, further comprising curing the packing structure to a compression of at most about 30%.

14. The method of claim 1, further comprising curing the packing structure to a hardness of about 48 to 58 Shore A.

15. The method of claim 1, wherein at least one of the rotationally sensitive device is a sub-munition with a fuze slide, the method including arranging the sub-munition so that the fuze slide is rotationally oriented in a predetermined direction, and inserting elastic packing structure that prevents rotation of the sub-munition.

16. The method of claim 1, further comprising inserting an outer spacer bar member along an inner periphery of the main body, wherein the step of arranging the rotationally sensitive devices includes arranging at least one of the rotationally sensitive devices against the spacer bar member, and the step of inserting packing structure into the main body includes inserting packing structure more resilient than the outer spacer bar member.

17. The method of claim 16, wherein the step of inserting an outer spacer bar member along an inner periphery of the main body includes inserting a plurality of sections forming the outer spacer bar member along the inner periphery of the main body with at least two of the plurality of sections being less resilient than the packing structure.

18. The method of claim 1, wherein the step of inserting packing structure into the main body includes inserting a resilient sleeve that is substantially grooveless in a longitudinal direction of the resilient sleeve as the packing structure that deforms around each rotationally sensitive device and frictionally holds each rotationally sensitive device.

19. The method of claim 1, wherein the step of arranging the rotationally sensitive devices includes arranging rotationally sensitive devices having a substantially round outer wall, and the step of inserting packing structure includes inserting packing structure that deforms around and frictionally holds the substantially round outer wall to prevent the rotationally sensitive devices from migrating out of the pre-ejection position prior to ejection.

20. The method of claim 1, wherein the step of arranging the rotationally sensitive devices includes arranging sub-munitions that need not have rods or interlocking elements to prevent sliding and rotating when packed into the projectile.

21. A method of loading rotationally sensitive devices into a projectile adapted to spin upon being fired by an applied external force, the projectile having a hollow main body with a longitudinal axis; the method comprising the steps of:

arranging the rotationally sensitive devices as sub-munitions having fuze slides in the main body such that each fuze slide is oriented in a pre-ejection position; and inserting packing structure into the main body that deforms around each sub-munition and frictionally holds each sub-munition to prevent rotation of the sub-munition prior to ejection from the projectile and allows ejection of the sub-munitions from the projectile.

22. The method of claim 21, wherein the step of arranging the sub-munitions includes arranging the sub-munitions such that the fuze slide of each submunition is oriented substantially radially outward from the longitudinal axis of the main body.

23. The method of claim 21, further comprising inserting an outer spacer bar member along an inner periphery of the main body, wherein the step of arranging the sub-munitions includes arranging at least one of the sub-munitions against the spacer bar member, and the step of inserting packing structure into the main body includes inserting packing structure more resilient than the outer spacer bar member.

24. The method of claim 23, wherein the step of inserting an outer spacer bar member along an inner periphery of the main body includes inserting a plurality of sections forming the outer spacer bar member along the inner periphery of the main body with at least two of the plurality of sections being less resilient than the packing structure.

25. The method of claim 21, wherein the step of inserting packing structure into the main body includes inserting a resilient sleeve that is substantially grooveless in a longitudinal direction of the resilient sleeve as the packing structure that deforms around each sub-munition and frictionally holds each sub-munition.

26. The method of claim 21, wherein the step of arranging the rotationally sensitive devices includes arranging rotationally sensitive devices having a substantially round outer wall, and the step of inserting packing structure includes inserting packing structure that deforms around and frictionally holds the substantially round outer wall to prevent the rotationally sensitive devices from migrating out of the pre-ejection position prior to ejection.

27. The method of claim 21, wherein the step of arranging the rotationally sensitive devices includes arranging sub-munitions that need not have rods or interlocking elements to prevent sliding and rotating when packed into the projectile.

* * * * *